United States Patent [19]

Ibbott

[11] 4,269,793

[45] May 26, 1981

[54] CARBURETTOR FOR INTERNAL COMBUSTION ENGINE

[76] Inventor: Jack K. Ibbott, 4-17-7 Nishi Azabu, Minato-Ku, Tokyo, Japan

[21] Appl. No.: 919,309

[22] Filed: Jun. 26, 1978

Related U.S. Application Data

[63] Continuation of Ser. No. 732,288, Oct. 14, 1976, abandoned, which is a continuation-in-part of Ser. No. 610,886, Sep. 5, 1975, abandoned.

[30] Foreign Application Priority Data

Jul. 25, 1975 [JP] Japan ..... 50-91012

[51] Int. Cl.[3] ..... F02M 29/14

[52] U.S. Cl. ..... 261/65; 261/95; 261/96; 261/102; 261/78 R; 261/DIG. 55; 261/DIG. 39

[58] Field of Search ..... 261/95, 96, 99, 78 R, 261/101-104, 65, 107, DIG. 55, DIG. 39, DIG. 72; 123/141; 48/180 R

[56] References Cited

U.S. PATENT DOCUMENTS

| | | | |
|---|---|---|---|
| 1,073,727 | 9/1913 | Atwood | 261/107 |
| 1,283,154 | 10/1918 | Godward | 261/101 |
| 1,291,833 | 1/1919 | Godward | 261/DIG. 39 |
| 1,327,233 | 1/1920 | Grant | 261/65 |
| 1,398,899 | 11/1921 | Hughes | 48/180 R |
| 1,510,221 | 9/1924 | Herman et al. | 48/180 R |
| 1,857,565 | 5/1932 | Pahl et al. | 261/99 |
| 1,902,887 | 3/1933 | Oppenheim | 261/41 D |
| 1,949,522 | 3/1934 | Williams | 261/95 |
| 2,080,440 | 5/1937 | Scott | 261/95 |
| 2,149,460 | 3/1939 | Muller | 261/95 |
| 2,152,057 | 3/1939 | Killmeyer et al. | 261/DIG. 39 |
| 2,350,347 | 6/1944 | Gaugler | 261/99 |
| 2,470,652 | 5/1949 | Scofield | 261/94 |
| 2,530,716 | 11/1950 | Meynier | 261/95 |
| 2,580,013 | 12/1951 | Gazda | 261/99 |
| 2,606,751 | 8/1952 | Lacoste | 261/95 |
| 2,955,064 | 10/1960 | Frohmader | 261/94 |
| 2,996,290 | 8/1961 | Munden | 261/78 R |
| 3,170,969 | 2/1965 | Lerner et al. | 261/DIG. 72 |
| 3,352,545 | 11/1967 | Denine | 261/95 |
| 3,439,903 | 4/1969 | Tolnai | 261/50 A |
| 3,493,218 | 2/1970 | Castellucci | 261/DIG. 72 |
| 3,734,474 | 5/1973 | Olati | 261/95 |
| 3,743,258 | 7/1973 | Florentine | 261/95 |
| 3,810,607 | 5/1974 | Blohm | 261/78 R |
| 3,851,026 | 11/1974 | Heskett et al. | 261/DIG. 72 |
| 3,911,066 | 10/1975 | Ireland, Jr. | 261/DIG. 72 |
| 3,995,609 | 12/1976 | Klomp | 261/DIG. 55 |

FOREIGN PATENT DOCUMENTS

| | | | |
|---|---|---|---|
| 720533 | 5/1942 | Fed. Rep. of Germany | 261/78 R |
| 409183 | 2/1910 | France | 48/180 R |
| 755785 | 9/1933 | France | 123/141 |
| Ad.46346 | 4/1936 | France | 261/65 |
| 26412 | of 1910 | United Kingdom | 261/63 |
| 235672 | 1/1925 | United Kingdom | 261/99 |
| 245254 | 1/1926 | United Kingdom | 261/410 |
| 260320 | 10/1926 | United Kingdom | 261/99 |
| 313588 | 8/1930 | United Kingdom | 261/78 R |
| 399679 | 10/1933 | United Kingdom | 48/180 R |
| 881461 | 11/1961 | United Kingdom | 261/78 R |

OTHER PUBLICATIONS

Judge, Motor Manuals, Carburetor and Fuel Injection Systems, Apr. 1957, pp. 46-48, TL212, J8, Chapman & Hall, London.

*Primary Examiner*—Tim R. Miles
*Attorney, Agent, or Firm*—Wenderoth, Lind & Ponack

[57] ABSTRACT

A carburettor for an internal combustion engine is provided with a porous material of very fine porosity of less than 12$\mu$ at a part or parts where a difference in pressure is developed within the carburettor from a relatively low pressure to a relatively high pressure in the direction of the air-fuel stream by a displacement of linear flow of the air-fuel stream.

17 Claims, 1 Drawing Figure

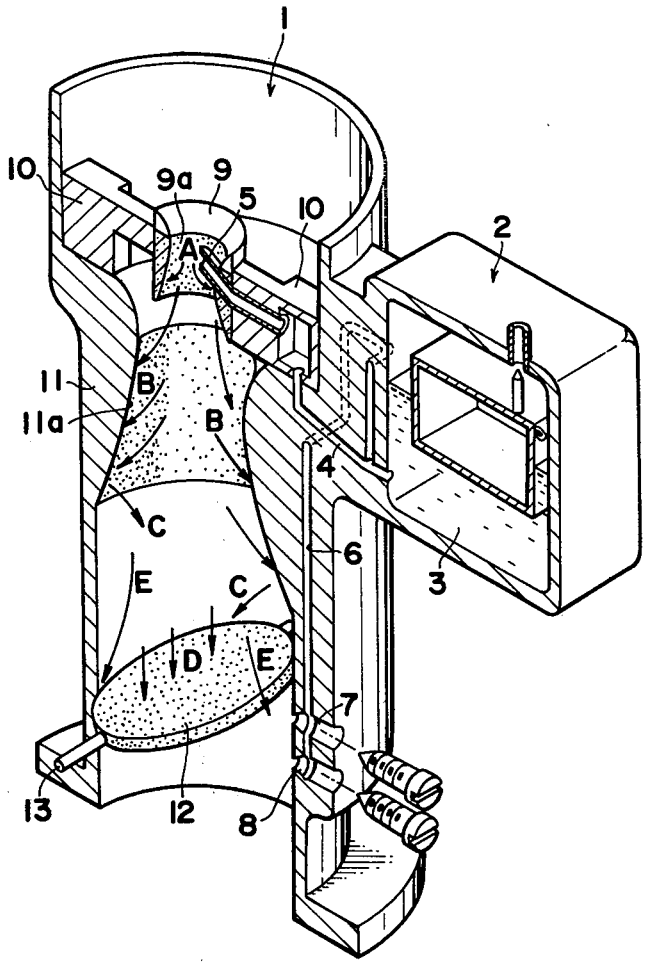
1
10
9a
9
5
10
2
A
11
B
11a
B
4
C
6
3
E
C
D
E
7
13
12
8

CARBURETTOR FOR INTERNAL COMBUSTION ENGINE

BACKGROUND OF THE INVENTION

This is a continuation of application Ser. No. 732,288, filed Oct. 14, 1976, now abandoned, which is a continuation-in-part application of U.S. patent application Ser. No. 610,886 filed on Sept. 5, 1975, now abandoned.

This invention relates to an improvement of a carburettor for increasing the vaporization rate of volatile fuels to be fed into combustion chambers in an internal combustion engine.

The vaporization rate of volatile fuels, such as petrol (gasoline), to be fed to combustion chambers in an engine is closely related to the amount of carbon monoxide (CO) and hydrocarbon (HC) discharged through the exhaust pipe from the automobile, and also to fuel economy. The discharged carbon monoxide and hydrocarbon cause pollution of the air, which, as is well known, is very harmful to human health.

Many proposals have been made hitherto to improve or increase the vaporization rate of the volatile fuels in a carburettor, such as to provide a mesh, foraminous material, or a porous material of coarse open porosity within the carburettor for breaking the fuel into a fine spray as it is drawn through the material, as shown in U.S. Pat. Nos. 1,327,233, 1,855,565, and 2,149,460 and British Pat. No. 245,254.

However, these proposals do not provide the desired advantage and in many cases have proven to cause a reduction in engine power and are, therefore, not put into practical use with satisfaction.

The present inventor has made extensive tests and research concerning improvements of the vaporization rate of fuel, and therefore an object of the present invention is to provide a carburettor for improving the vaporization rate of volatile fuel used in internal combustion engines so as to reduce the amount of carbon monoxide CO and hydrocarbon HC in the exhaust gas and to increase the fuel economy.

Another object of the present invention is to provide an improved carburettor as set forth above which can be applied very easily to any type of automobile now in use.

BRIEF SUMMARY OF THE INVENTION

The liquid fuel sprayed into the carburettor from a fuel delivery orifice is partly vaporized by the venturi action, while a part of the fuel fed therein remains still in the liquid state. The vaporized portion of the fuel is intimately mixed with the air and therefore it is not desirable or necessary to pass this air/fuel mixture through any vaporization device in view of the restricted flow caused therethrough. The fuel in the liquid state causes an increase of the amount of carbon monoxide CO and hydrocarbon HC in the exhaust gas and poor fuel economy. Accordingly, it is desired in the carburettor to pass only that fuel which is still in the liquid state through a vaporization device without passing the mixture of air and vaporized fuel therethrough.

It has been found by the present inventor that a porous material (medium or substance) having a very fine porosity readily absorbs a liquid fuel by capillary action but will not allow the mixture of air and vaporized fuel to pass therethrough. Such porous material does not release the absorbed liquid so readily but readily releases the absorbed liquid in the form of a gas or vapour.

In tests using porous materials having different fine porosities, it was noted that the porous material having a finer porosity showed stronger capillary action to fastly absorb volatile liquid fuel, to stongly retain the liquid fuel and to fastly release the fuel in the vapour state and that porous material having a porosity of less than $12\mu$ is usable with the present invention. However, a porosity of less than $2\mu$ would be more preferable.

For the purpose of making this invention more clear and apart from all other prior art, the definition of porous material as it is understood in this invention is "a material having minute openings of less than $12\mu$, and being in the nature of minute cells or spaces formed between particles of solid substance. The said minute cells being interconnected by minute spaces".

According to the present invention, a carburettor for an internal combustion engine is provided in the longitudinal sense with a porous material of very fine porosity of less than $12\mu$ at a part or parts where a difference in pressure is developed within the carburettor from a relatively low pressure to a relatively high pressure in the direction of the air-fuel stream by a displacement of linear flow of the air-fuel stream, and in the transverse sense at a part or parts where a difference in pressure is developed within the carburettor from a relatively high pressure to a relatively low pressure in the direction of the air-fuel stream.

The substance from which the porous material is formed need not necessarily be specified, so long as it is a stable substance which retains its form in the conditions of heat and which is unaffected by the fuel. Many substances would fit these requirements, such as Plaster of Paris, gypsum, ceramic, sintered metal, any kind of substance which can be formed into a fine powder and then by some means of perhaps heat or pressure be formed into a compacted mass retaining the desired porosity, or be such substance like Plaster of Paris which will form itself into the required porous mass when treated with some setting agent which in the case of Plaster of Paris is the simple procedure of mixing the dry Plaster of Paris powder with water, and etc. The improvement feature being that the substance particle size be fine and that the porosity between particles of the substance be less than $12\mu$ and preferably less than $2\mu$.

The condition requirement for the porous material is that when the porous material is wetted or loaded with a liquid (fuel) it takes the characteristic of a non-porous material, that is, the liquid filling the pores of the porous material forms a "blockage" and will prevent the passage of any flow of gas or air therethrough unless considerable pressure is applied sufficient to dislodge the liquid contained in the material pores, such pressure being in excess of any pressure which might exist under normal operating conditions within the carburettor. It is not desirable that the liquid fuel be forced out from the porous material in the form of a liquid spray. The condition required is that the porosity be so fine as to strongly retain the liquid and allow it only to be released in the form of a gas or vapour. The very character of fine porosity causes rapid conversion of the liquid fuel into the gaseous or vapour state.

It should be clearly understood that in this invention it is not the objective to break the fuel into a fine liquid spray. The function of the porous material is to absorb the liquid fuel and release it only in the gaseous or vapour state. This is achieved by using a material of very fine porosity of less than 12μ. The finer the porosity the better the conversion from liquid state to vapour state. It is believed by the inventor that when the liquid fuel is absorbed into the very fine porous material the liquid is dispersed throughout the pores and broken into individual parts of pore size. With such finely dispersed fuel the conversion from liquid state to gaseous or vapour state more readily takes place. In a sense the porous material is of such fine porosity that it can be considered as a catalyst in the physical sense or promoting the physical change from liquid state to gaseous or vapour state as in the similar sense of a catalyst which promotes chemical change.

It is important that the porous material of such fine porosity as explained above may only be used in those areas or parts of the carburettor where in the longitudinal sense a difference of pressure is developed from a relatively low pressure to a relatively high pressure in the direction of the air-fuel stream by a displacement of linear flow of the air-fuel stream, and in the transverse sense at those areas or parts of the carburettor where a difference in pressure is developed within the carburettor from a relatively high pressure to a relatively low pressure in the direction of the air-fuel stream. The porous material may be used as a longitudinal or transverse communication link between the areas of low to higher pressure, and high to lower pressure in the direction of the air stream through the carburettor. The application of the very fine porosity material to the primary venturi and carburettor throat may be cited as an example of longitudinal communication between the low pressure at the smaller diameter of the venturi to the higher pressure area of the larger diameter of the venturi. In the transverse sense the very fine porosity of the butterfly disc is the communication link between the up-stream or carburettor side area at one pressure to the down-stream or intake passage side area at a relatively lower pressure. The application of such very fine porosity material to any area where there is no communication between pressure difference areas will result in zero effect and in some cases the inventor experienced a loss of performance below that of a standard type carburettor.

As will be noted from the disclosure set forth above, preferable parts in the carburettor where the porous materials are provided are as follows:

(1) Primary venturi tube, (2) Carburettor throat, or secondary venturi, (3) Butterfly throttle valve.

In these parts set forth above, the primary venturi tube and the butterfly throttle valve are formed or made of the porous material, while the carburettor throat is coated with the porous material. When all of the parts (1)–(3) are formed of or coated with the porous material, the vaporization rate of the fuel is most improved since the vaporization rate thereof is cumulatively enhanced while the volatile fuel is absorbed and then released as a gas or vapour, at these parts successively in turn. However, a remarkable improvement of the vaporization rate of the fuel is also obtained when one only of either of the venturi tube or the butterfly throttle valve is formed of the porous material.

Reference is now made to the requirements when using the porous material on the parts of the carburettor set forth above.

(a) Primary venturi

It is important that the porosity of the material be very fine to prevent the passage of air through the porous part. In this primary venturi there is a relatively low pressure area at the interior small diameter part or throat and a relatively higher pressure area at the interior large diameter part downstream of the throat. However, there is also a relatively higher pressure area on the outside surface of the primary venturi and if the material of the primary venturi will allow the passage of air transversely therethrough this will cause low efficiency of the venturi action because the difference in pressure developed between the small diameter area and the large diameter area will be reduced. In a relatively similar sense this can be compared to air leaking into a vacuum chamber where in such case it is impossible to achieve the desired degree of vacuum. Furthermore, if the porosity is large enough to permit the passage of air therethrough, this will defeat the objective of the invention. Air passing through the wet porous material will carry with it wet or liquid fuel in the form of bubbles or spray and to some extent condensation of the liquid fuel particles occurs and it combines into larger drops of liquid. To achieve peak performance the porous material of the primary venturi should have such fine porosity that when wet with the liquid fuel absorbed into the pores it will resist the passage of air therethrough and hold the liquid fuel strongly. The effect of the fine porosity combined with a lowering of pressure provides efficient gasification of the absorbed liquid fuel. The primary venturi should only be porous in the divergent section, i.e. that part which is expanding in diameter in the direction of the air stream, that is from the smaller diameter to the larger diameter, and should not be porous at the converging section or mouth part of the primary venturi where the diameter is changing from larger diameter to the smaller diameter in the direction of the air stream. The use of the porous material at the mouth part of the primary venturi where the air is entering and being accelerated has a negative effect in that it partly cancels the efficiency of the porous material used at the expanding part where the air velocity is being lowered. In the original tests the porous material used was Plaster of Paris which had a porosity of less than 12μ.

(b) Throat or secondary venturi

In a relatively lower air speed area as compared with the primary venturi there is a smaller difference in pressure between the relatively low pressure and relatively higher pressure areas. Therefore, the porous material must be in a very thin layer or film when the communication is in the longitudinal sense between the relatively low pressure area and the relatively higher pressure area. Also, as in the case of the primary venturi the porous layer should only communicate between the smaller diameter area to the larger diameter area in the direction of the air stream and not be applied at the mouth of the throat where the air is entering and being accelerated.

It was found that any use of the porous material, in a very thin layer or a thick layer, in the linear parts of the carburettor where there was no communication between a relatively low pressure to a relatively higher pressure, that is, where there is no displacement of the linear flow of the air fuel stream, such as the straight sided barrel following the large venturi or throat, would cause a drastic drop in performance and the engine would become very sluggish.

(c) Butterfly throttle valve

In the case of the butterfly the porous material is used in the transverse sense with the high pressure area on one side of the porous material disc and the low pressure area on the other side of the porous material disc. Also in the case of the butterfly the conditions of porosity as previously described are of utmost importance. It was found that the porosity must be homogeneous for optimum conditions, and again the porosity should be less than 12μ. This is especially important for the butterfly throttle at which the maximum pressure difference within the carburettor occurs and which can become as much as 14.7 psi at the high pressure side and down to 5 psi at the low pressure side when the engine is idling or running down hill with the throttle closed. The porous material should have high resistance to "blow through", that is, the high pressure on the one side (carburettor side) and the low pressure on the other side (intake passage) should be held by the absorbed liquid petrol in the pores of the porous material without the pressure blowing the liquid petrol through and out the low pressure side in the form of a liquid spray.

The aforementioned and other objects and features of the present invention shall be described hereinafter in detail with reference to a preferred embodiment thereof shown in the accompanying drawing, in which:

DESCRIPTION OF THE DRAWING

The single drawing is a partially sectioned perspective view showing a fuel feeding device for an internal combustion engine, modified according to the present invention.

DETAILED DESCRIPTION OF THE INVENTION

In a fuel feeding device shown in the drawing a carburettor 1 is connected with a float chamber 2, by which fuel 3 in the float chamber 2 is supplied into the carburettor 1 through a supply passage 4 opened into the carburettor 1 by a main fuel delivery orifice 5 or another supply passage 6 opened into the carburettor by idle and intermediate fuel delivery orifices 7 and 8.

A primary venturi tube 9 is concentrically supported within the carburettor 1 by radial arms 10, through one of which the tip portion of the supply passage extends and the main fuel delivery orifice 5 opens in a throat, i.e. hollow space, in the axial center of the primary venturi tube 9. The primary venturi tube 9 has an internal configuration including a converging section which rapidly converges to a relatively small diameter and a diverging section which slowly expands from the small diameter, while the outside diameter is linear in form, the internal shape of the tube defining the throat. The internal shape of the carburettor 1 below the primary venturi tube 9 is similar to the internal shape of primary venturi tube 9, thereby forming a carburettor throat, or secondary venturi, 11. Provided below the carburettor throat 11 is a disc-shaped butterfly throttle valve or butterfly 12 which is rotatably supported within the carburettor 1 by a shaft 13. The idle and intermediate fuel delivery orifices 7 and 8 open into the carburettor 1 at positions adjacent to the butterfly throttle valve 12.

The present invention is applied to such a known fuel feeding device set forth above without alteration or modifying the shape and configuration of the device in substance.

That is, in a preferred embodiment of the present invention shown in the drawing, porous material 11*a* having a porosity of less than 12μ preferably less than 2μ is provided or coated on the internal surface of the carburettor throat 11, while the primary venturi tube 9 and the butterfly throttle valve 12 are formed of porous material having a porosity of less than 12μ.

As there are several parts of the carburettor on which, or for which the porous materials are used, for the purpose of clarity, the functions of the porous material provided at these parts shall be described individually hereinafter.

(1) The primary venturi tube

In the primary venturi tube 9 having the internal configuration of a tube which converges relatively rapidly from a larger diameter to a smaller diameter, and then relatively slowly expands from the smaller diameter to a large diameter, a lowering of pressure develops in the smaller diameter part of the tube when air is drawn through the primary venturi tube 9. This lowering of pressure is caused by the displacement of the linear air flow, and the lowering of pressure draws the liquid fuel through the main fuel delivery orifice 5 causing the liquid fuel to be sprayed into the air stream passing through the primary venturi tube 9. In view of the expanding diameter of the downstream part of the primary venturi tube 9, the stream of air entering at the small diameter end is caused to expand (displacement of the linear flow) as it passes through the expanding diameter of the primary venturi tube 9, and this expanding action causes a non-vaporized or still liquid part of the fuel in the spray emitted from the main fuel delivery orifice 5 to be thrown onto the inside walls of the expanding diameter portion of the primary venturi tube 9 as shown by arrows A. Also, because of the lowering of pressure adjacent orifice 5 as mentioned above, a further part of the fuel emitted from the main fuel delivery orifice 5 is converted into a vapour.

In a known venturi tube made of solid metal, that liquid part of the fuel spray which is thrown onto the inside wall of the primary venturi tube drains down the walls and drips off the lower edge of the primary venturi tube. In this manner part of the effect of the primary venturi tube and fuel delivery orifice 5 in breaking the liquid fuel into a spray is neutralized because of the spray being condensed back into large drops of liquid fuel.

When that part 9*a* of the primary venturi tube 9, which is of expanding diameter from the small diameter to a larger diameter in the direction of the air stream therethrough, is made of a very finely porous material of less than 12μ porosity in place of the standard solid metal, some of the liquid fuel, which as is described above is thrown onto the inside wall 9*a* which is now formed of the very finely porous material, will be absorbed into the porous material. The liquid fuel so absorbed will be released from the porous wall in the form of a gas, or vapour, as it progresses towards the larger diameter part in the direction of the air-fuel stream. The absorbed liquid fuel will not condense and drip off the lower edge of the primary venturi tube 9 as described in the case of the standard solid metal.

Thus, when that part 9*a* of the primary venturi tube 9 extending from the smaller diameter to the larger diameter in the direction of the air stream therethrough is formed or made of very finely porous material of less than 12μ porosity, the vaporization rate of the fuel passing therethrough is remarkably improved as compared with that attained by the standard type primary venturi tube made of solid metal. Furthermore, condensation of the fuel into large drops is also prevented.

(2) The carburettor throat or secondary venturi

The carburettor throat 11 has an internal shape similar to the internal shape of the primary venturi tube 9 and the action is the same as that of the primary venturi tube 9 in that the pressure is raised from the pressure at the smaller diameter part as the diameter of the throat increases. The normal action of the carburettor throat 11 is to further vaporize any still liquid portion of the fuel coming from the primary venturi tube by the lowering of pressure. As the air-fuel stream leaves the primary venturi tube 9, because of the rapid expansion into a larger diameter, the remaining liquid portion of the fuel spray is thrown against the walls of the carburettor throat 11 and drains down the metal walls of the conventional carburettor throat.

When the carburettor throat 11 is coated or provided with a very finely porous material 11*a* having a porosity of less than 12$\mu$ at the inner walls thereof, at that part only from the smaller diameter to the larger diameter in the direction of the air stream, in accordance with the present invention, the fuel spray thrown against the walls 11*a* of the throat as shown by arrows B will be absorbed into the porous material and will be released, as shown by arrows C, in the form of a gas or vapour from the porous material walls 11*a* of the throat 11 as it progresses towards the larger diameter part. This action is the same as previously described for the primary venturi tube 9.

Thus, when the carburettor throat 11 is coated or provided with the finely porous material 11*a* of less than 12$\mu$ porosity, the vaporization rate of the fuel is improved as compared with that attained by the standard carburettor throat 11 having solid inner walls, and furthermore, the fuel is restrained from dripping or draining down the carburettor throat walls into the intake manifold of the engine.

In initial experiments, the porous material used was Plaster of Paris mixed to a very thin consistency with water and lightly painted over the required area with a brush. Attempts to apply a thicker layer of the porous material over the area resulted in downgrading of the performance. The indication used for the preferable thickness of the porous layer was that the layer would show transparent when wet with fuel. Any thickness greater than this which would not become transparent when wet with fuel resulted in a loss of efficiency. Preferable thickness of the porous layer should be less than 0.3 mm.

(3) The butterfly throttle valve

The butterfly throttle valve is used to control the amount of fuel and air delivered into the internal combustion engine, and accordingly controls the speed, rpm, of the engine. The butterfly of known type is normally a solid metal disc attached to a shaft 13, whereby the rotation of the shaft 13 causes the butterfly to move in such a manner as to control the amount of air-fuel mixture being drawn into the internal combustion engine.

According to the present invention, the disc part of the butterfly 12 is composed entirely of the very finely porous material of less than 12$\mu$ porosity. In this case the action of speed control of the internal combustion engine is still functional as with the normal metal disc butterfly. However, as the butterfly is made of very finely porous material having a porosity of less than 12$\mu$, any remaining liquid fuel portion carried in the air-fuel stream coming from the previous parts of the carburettor will impinge on and be absorbed into the upper surface as shown by arrows D, i.e. the surface of the porous material butterfly disc 12 facing towards the oncoming air-fuel stream, and as the porosity of the material of the butterfly disc is so fine as to substantially restrict the flow of air and fuel vapour therethrough, the air and fuel vapour will by-pass around the edge of the butterfly disc 12 as shown by arrows E.

Because there is a difference of pressure between the upper surface of the finely porous butterfly and the lower surface thereof, in that the lower surface is at a lower pressure, the liquid fuel impinging on and being absorbed into the upper surface will be released from the lower surface in the form of a gas, or vapour.

Thus, when the butterfly throttle valve 12 is formed or made of very finely porous material having a porosity of less than 12$\mu$, the vaporization rate of the fuel is remarkably improved compared with that attained by a butterfly made of a normal solid metal disc.

The present device of the type shown in the drawing was subjected to tests to check the amount of CO and HC emissions in the exhaust gas and driving distance per unit of fuel. The tests were carried out using a 1600 cc Isuzu Florian with and without the porous material in the carburettor. The porous material used in the present device was Plaster of Paris having a porosity of less than 12$\mu$. The porous material was coated over the required area of the carburettor throat with the thickness of about 0.2 mm. The butterfly made of Plaster of Paris was formed over a metal web frame for structural strength in which the thickness of Plaster of Paris butterfly was approximately 2.5 mm.

In the tests, gas sensors for CO and HC were installed in the car and meters reading the relative amounts of each gas were installed in front of the driver to show instant readings of gas emission under the particular driving conditions. These meter readings were only relative and did not show actual percentages, parts per million, or grm/kilometer. Another meter showing an instant reading of kilometer/liter was also installed, and in this case the meter was accurately calibrated and showed actual readings of kilometers/liter.

| | Test Results | |
|---|---|---|
| | standard carburettor without porous material (meter readings) | carburettor with porous material (meter readings) |
| CO emission | | |
| engine idling | 3 | 1.5 to 2 |
| driving (40 km/hr.) | 10+ | 3.5 to 4 |
| HC emission | | |
| engine idling | 3 | 2 |
| accelerating | 10+ | 4 |
| driving (40 km/hr.) | 9 | 3 |
| Kilometers/liter (city driving) | 7 to 8 | 10 to 11 |

In the above table, the meter reading shown as 10+ means that the meter indicator had passed the maximum reading and was hard against the stop. These readings could have been in the order of 15 or more could the meter scale have been extended.

It was found in the tests that when the parts of the carburettor were treated with the porous material the fuel delivery orifices could be reduced in size by about 30% for the same engine power and performance as obtained with the standard carburettor. This would be because of the increase in the amount of fuel having vaporized.

After using the treated carburettor for approximately 500 kilometers it was found that the spark plugs had become clean and had no deposit of black carbon. These spark plugs had been previously used with the standard carburettor and had developed a heavy deposit of carbon on the metal base part.

It was also noted in the tests that the black carbon deposit on the inside of the exhaust pipe had changed and the color had become a medium brown. This would indicate the absence of free carbon in the engine exhaust and the brown color was from the additives in the fuel.

As is apparent from the disclosure and the test results set forth above, according to the device of the present invention, the liquid fuel coming into and out of the carburettor is effectively gasified or vaporized, by the very finely porous material and the gasified, or vaporized, fuel is intimately mixed with the air-fuel stream, so that the air-fuel mixture fed into the combustion chambers in the engine will be almost completely burned, with the result that the emissions of CO and HC in the exhaust gas are remarkably reduced and the economy of the automobile using the present device is considerably increased.

Although the present invention has been described with reference to the preferred embodiment thereof, many modifications and alterations may be made thereto, and the present invention may be applied to carburettors having any other different shapes or configurations.

What is claimed is:

1. A carburetor for an internal combustion engine, said carburettor comprising:

a venturi into which passes air, said venturi including a throat and a portion diverging in the downstream direction from said throat, the pressure in said venturi increasing in the downstream direction from said throat;

main fuel delivery orifice means for spraying liquid fuel into the interior of said venturi at said throat such that a portion of said sprayed fuel is converted into vapor which joins with said air to form an air and vaporized fuel mixture and a further portion of said sprayed fuel is thrown in liquid form against the interior walls of said diverging portion of said venturi;

a butterfly throttle valve positioned downstream of said venturi and comprising a disc having a first surface facing said venturi and a second surface facing away from said venturi, the pressure within said carburetor adjacent said first surface being greater than the pressure adjacent said second surface; and said venturi being provided from said throat longitudinally throughout said diverging portion with means for vaporizing any liquid portion of said fuel passing thereby, said means comprising porous material having a porosity of less than 2$\mu$ and formed of minute interconnected cells, said porosity being insufficient to allow passage through said porous material of said air and vaporized fuel mixture and insufficient to allow any condensation within said porous material of the thus vaporized fuel, said porous material being capable of being wetted by said fuel in liquid form, such that said liquid fuel is absorbed by said porous material and all of said absorbed fuel is vaporized internally of said porous material and is released therefrom in vapor form in said downstream directions due to said porosity and said increasing pressure.

2. A carburettor for an internal combustion engine as claimed in claim 1, wherein said porous material is provided from said throat longitudinally throughout said diverging portion only.

3. A carburettor for an internal combustion engine as claimed in claim 1, wherein said venturi comprises a primary venturi tube and a secondary venturi, only said primary venturi tube being provided with said porous material, at a part thereof which extends from said throat throughout said diverging portion.

4. A carburettor for an internal combustion engine as claimed in claim 3, wherein said part of the venturi tube is made of said porous material.

5. A carburettor for an internal combustion engine as claimed in claim 1, wherein said venturi comprises a primary venturi tube and a secondary venturi, only said secondary venturi being provided with said porous material, at a part thereof which extends from said throat throughout said diverging portion.

6. A carburettor for an internal combustion engine as claimed in claim 5, wherein said porous material is coated over said part of said secondary venturi to a thickness of less than 0.3 mm.

7. A carburettor for an internal combustion engine as claimed in claim 1, wherein said butterfly throttle valve is provided with means for vaporizing any liquid portion of said fuel passing thereby, said means comprising porous material having a porosity of less than 12$\mu$, said porosity being insufficient to allow passage through said porous material of said air and vaporized fuel mixture, said porous material being capable of being wetted by said fuel in liquid form, such that said liquid fuel is absorbed by said porous material and is released therefrom in vapor form in said downstream direction.

8. A carburettor for an internal combustion engine as claimed in claim 7, wherein said butterfly disc is made of said porous material.

9. A carburettor for an internal combustion engine as claimed in claim 1, wherein said venturi comprises a primary venturi tube and a secondary venturi, both of said primary venturi tube and said secondary venturi being provided with said porous material, at respective parts thereof which extend from the respective said throats thereof throughout the respective said diverging portions thereof.

10. A carburettor for an internal combustion engine as claimed in claim 9, wherein said part of said primary venturi tube is made of said porous material, and said part of said secondary venturi is coated with said porous material to a thickness of less than 0.3 mm.

11. A carburettor for an internal combustion engine as claimed in claim 9, wherein said butterfly throttle valve is provided with means for vaporizing any liquid portion of said fuel passing thereby, said means comprising porous material having a porosity of less than 12$\mu$, said porosity being insufficient to allow passage through said porous material of said air and vaporized fuel mixture, said porous material being capable of being wetted by said fuel in liquid form, such that said liquid fuel is absorbed by said porous material and is released therefrom in vapor form in said downstream direction.

12. A carburettor for an internal combustion engine as claimed in claim 11, wherein said butterfly disc is made of said porous material.

13. A carburetor for an internal combustion engine, said carburetor comprising:

a throttle butterfly disc made of porous material having a porosity of less than 12μ; and a venturi tube made over a portion thereof of porous material having a porosity of less than 2μ and formed of minute interconnected cells, said portion extending longitudinally from a relatively small diameter part of said venturi tube to a relatively large diameter part of said venturi tube.

14. A carburetor for an internal combustion engine, said carburetor comprising:

a venturi into which passes air, said venturi including a throat and a portion diverging in the downstream direction from said throat, the pressure in said venturi increasing in the downstream direction from said throat;

main fuel delivery orifice means for spraying liquid fuel into the interior of said venturi adjacent said throat such that a portion of said sprayed fuel is converted into vapor which joins with said air to form an air and vaporized fuel mixture and a further portion of said sprayed fuel is thrown in liquid form against the interior walls of said diverging portion of said venturi;

a butterfly throttle valve positioned downstream of said venturi and comprising a disc having a first surface facing said venturi and a second surface facing away from said venturi, the pressure within said carburetor adjacent said first surface being greater than the pressure adjacent said second surface; and said butterfly throttle valve being provided with means for vaporizing any liquid portion of said fuel passing thereby, said means comprising porous material having a porosity of less than 2μ and formed of minute interconnected cells, said porosity being insufficient to allow passage through said porous material of said air and vaporized fuel mixture, said porous material being capable of being wetted by said fuel in liquid form, such that said liquid fuel is absorbed by said porous material and is released therefrom in vapor form in said downstream direction.

15. A carburettor for an internal combustion engine as claimed in claim 14, wherein said butterfly disc is made of said porous material.

16. A carburetor for an internal combustion engine; said carburettor comprising:

a throttle butterfly disc made of porous material having a porosity of less than 12μ; and a carburetor throat coated over a portion thereof with porous material having a porosity of less than 2μ and formed of minute interconnected cells, said coated portion extending longitudinally from a relatively small diameter part of said throat to a relatively large diameter part of said throat.

17. A carburettor as claimed in claim 16, further comprising a venturi tube made over a portion thereof of porous material having a porosity of less than 12μ, said portion of said venturi tube extending longitudinally from a relatively small diameter part thereof to a relatively large diameter part thereof.

* * * * *